US008863945B2

(12) United States Patent
Davis

(10) Patent No.: US 8,863,945 B2
(45) Date of Patent: Oct. 21, 2014

(54) JEWELRY ORGANIZER AND METHOD FOR ORGANIZING AND STORING JEWELRY

(76) Inventor: Linda Davis, Wheaton, IL (US)

( * ) Notice: Subject to any disclaimer, the term of this patent is extended or adjusted under 35 U.S.C. 154(b) by 0 days.

(21) Appl. No.: 13/338,817

(22) Filed: Dec. 28, 2011

(65) Prior Publication Data

US 2013/0168268 A1 Jul. 4, 2013

(51) Int. Cl.

| | |
|---|---|
| ***A45C 11/04*** | (2006.01) |
| ***B65D 73/00*** | (2006.01) |
| ***B65D 30/22*** | (2006.01) |

(52) U.S. Cl.

USPC ..... 206/6.1; 206/495; 383/39

(58) Field of Classification Search

USPC ..... 206/6.1, 486–489, 495; 383/38–40

See application file for complete search history.

(56) References Cited

U.S. PATENT DOCUMENTS

| | | | | | |
|---|---|---|---|---|---|
| 3,900,060 | A * | 8/1975 | Shammas | 206/6.1 |
| 4,401,219 | A * | 8/1983 | Mink | 206/6.1 |
| 4,958,727 | A * | 9/1990 | Bergeron | 206/6.1 |
| 5,351,813 | A * | 10/1994 | Golovan | 383/39 |
| 5,779,033 | A * | 7/1998 | Roegner | 206/6.1 |
| 5,897,209 | A * | 4/1999 | Roegner | 383/39 |
| 5,984,092 | A * | 11/1999 | Heard-Willmon | 383/38 |
| 6,715,594 | B2 * | 4/2004 | Milionta et al. | 190/110 |

* cited by examiner

*Primary Examiner* — Bryon Gehman

(74) *Attorney, Agent, or Firm* — Hinshaw & Culbertson LLP

(57) ABSTRACT

A jewelry organizer, a jewelry organizing system, and a method for organizing jewelry are provided. The jewelry organizer includes a storage unit and storage compartments that are both removable and interchangeable, and are used for storing jewelry, fashion accessories or other small items. The jewelry organizing system includes a compact unit, and storage compartments are removable and interchangeable between the storage unit and the compact unit.

8 Claims, 2 Drawing Sheets

JEWELRY ORGANIZER AND METHOD FOR ORGANIZING AND STORING JEWELRY

FIELD OF THE INVENTION

The present invention relates to an organizer and organizing system for jewelry and other items. The present invention also relates to a method for organizing and storing jewelry and other items.

BACKGROUND OF THE INVENTION

Jewelry and other fashion accessories can take up a lot of room. Necklaces, bracelets, and earrings can easily get tangled with one another when stored in the same location and not separated.

When travelling, it can be difficult to organize jewelry and fashion accessories to prevent them from tangling or getting lost. Additionally, current airline rules and regulations require you to limit the amount of luggage that you bring on an airplane. A need exists for a compact, easy to use organizer for jewelry and fashion accessories when travelling.

BRIEF SUMMARY OF THE INVENTION

The present invention provides an organizer for storing and organizing items such as jewelry and other fashion accessories. The jewelry organizer is typically a generally rectangular storage unit and a plurality of compartments. The compartments are typically removably attached to the storage unit and comprise a seal. Typically, each compartment is appropriately sized to contain one piece of jewelry (or a pair of jewelry items such as earrings).

The storage unit can include a crease and a closure. The storage unit can include multiple creases that will allow the storage unit to be easily folded in order to create a more streamlined unit. The closure allows the storage unit to be closed in order to maintain a folded configuration. The closure can be any type of fastener that will allow the storage unit to maintain a folded configuration. Examples of appropriate closures include, but are not limited to, a tie closure, a zipper, a snap, hook and loop fasteners, or an elastic closure.

In another aspect of the invention, a crease in the storage unit should be sufficient to allow the storage unit to be folded along the crease.

The compartments are typically removably attached to the storage unit. Typically the compartments are attached to the storage unit by hook and loop fasteners. The compartments can also be removably attached to the storage unit by any type of mechanical fastener or adhesive fastener. Mechanical fasteners include zippers or snaps or any other appropriate mechanical fastener.

In another aspect of the invention, the compartments are made of a plastic, such as polyethylene terephthalate (PET). Typically the compartments are made of a clear or see-through plastic that allows the user to see the contents of the compartment.

The compartment typically contains a seal. Typically the seal is an interlocking strip fastener. Alternatively, the seal can be a hook and loop fastener.

The compartments are generally rectangular in shape. Typically, the compartments are at least about two inches wide by about two inches long in size.

The compartments may vary in size to accommodate items of different sizes. In one embodiment, the jewelry organizer includes two compartments, and the first compartment has a width and the second compartment has a width that is two times the width of the first compartment.

The present invention provides a jewelry organizing system. The jewelry organizing system includes a generally rectangular storage unit, a generally rectangular compact unit, and a plurality of compartments. The compartments each have a seal and the compartments are removably and interchangeably attached to either the storage unit or the compact unit.

The compact unit typically includes at least one crease and a closure. The crease allows the compact unit to be folded along the crease. The closure can be any appropriate closure. Typically, the closure is a tie closure, a zipper closure, a mechanical fastener, a hook and loop closure, or an elastic closure.

The compact unit is smaller than the storage unit.

Typically, the storage unit includes at least one hook and loop fastener, the compact unit includes at least one hook and loop fastener, and the compartments include a hook and loop fastener to removably and interchangeably attach the compartments to the storage unit or the compact unit.

Alternatively, the compartments can be removably and interchangeably attached to the storage unit and the compact unit by a mechanical fastener.

Typically, the compartments are plastic, such as a clear or see-through plastic, and typically include a seal that is an interlocking strip fastener.

The compartments are generally rectangular in shape and are at least about two inches wide by about two inches long in size.

The invention also provides a method for storing jewelry. A jewelry organizer system is provided. The jewelry organizer system includes a generally rectangular storage unit, a generally rectangular compact unit including at least one crease and a closure, and a plurality of compartments. The compartments include a seal and are removably and interchangeably attached to either the storage unit or the compact unit. At least one of the compartments is filled with a piece of jewelry or fashion accessory. The filled compartment is attached to the storage unit. The filled compartment is subsequently removed from the storage unit and is attached to the compact unit.

DETAILED DESCRIPTION OF THE INVENTION

Figure 1:
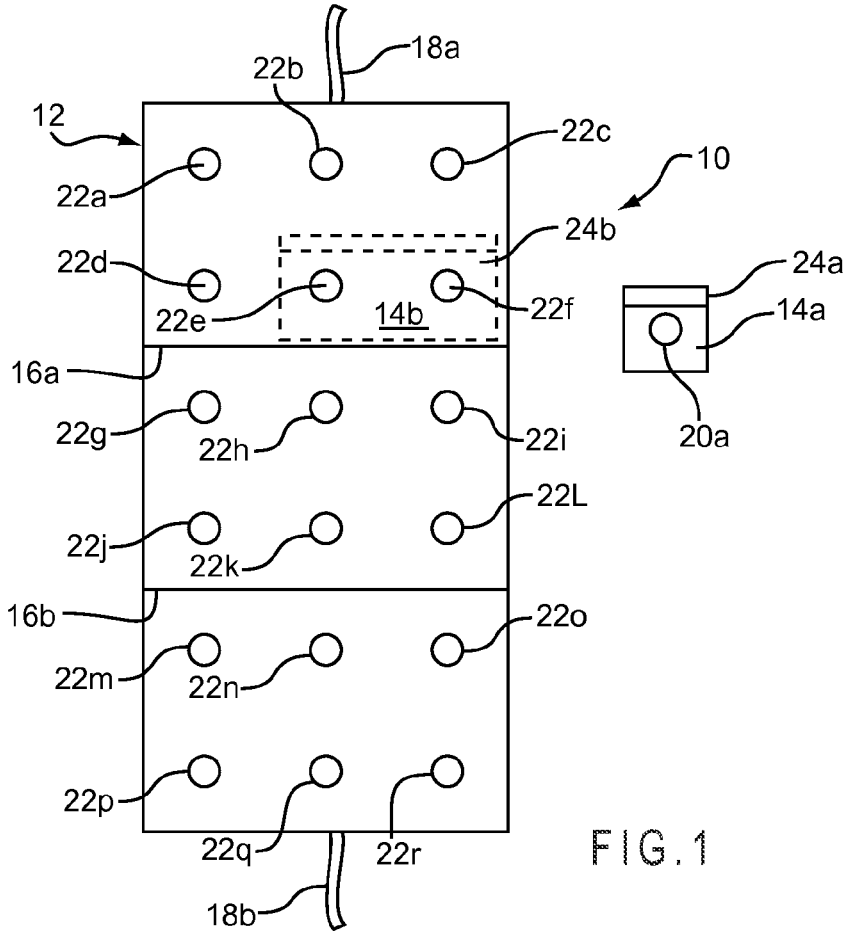
FIG. 1 is an illustration of a jewelry organizer in accordance with the present invention.

The present invention is directed to a jewelry organizer. The jewelry organizer of this invention can be used to store and organize jewelry or fashion accessories. The jewelry organizer of this invention can also be used to store and organize any small items that need to be separated or stored and that can be individually stored.

Jewelry items that are typically stored include pairs of earrings, necklaces, bracelets, anklets, charms, rings, cufflinks or any other type of jewelry that would fit in the compartments. Fashion accessories that can be stored and organized in the jewelry organizer include, but are not limited to, barrettes, ribbons, brooches, or any other fashion accessories that are appropriately sized to fit in the compartments.

Any other items that are appropriately sized to fit into the compartments can be stored and organized in the compartments. Examples of other items are makeup items such as makeup brushes, makeup applicators, eye shadow, eye liner, mascara, bronzer, blush, lipstick, lip gloss, lip balm, or any other makeup product. Additionally small items such as pills or vitamins can be stored in the compartments.

The jewelry organizer includes a storage unit and a plurality of compartments that are removably attached to the storage unit. The storage unit is generally rectangular in shape.

The storage unit can be of varying sizes as appropriate for the number of compartments that will be attached to the storage unit. Typically, the storage unit will be between about 8 inches and about 24 inches wide and between about 8 inches and about 36 inches long. More typically, the storage unit is about 12 inches wide and is about 18 inches long.

The storage unit can be made of any appropriate material. Typically, the storage unit is made from a cloth material, such as cotton, polyester, or a cotton/polyester blended material. The storage unit can also include nylon, silk, rayon, or any other cloth material. Alternatively, the storage unit can be made from any plastic material, such as a PET material.

The storage unit includes a closure. The closure can be any appropriate closure such as a tie closure, a zipper, a snap, hook and loop fasteners, or an elastic closure Typically the closure is a tie. The storage unit may also include a hanger in order to allow the storage unit to be easily hung for storage, such as in a closet or on a hook.

The storage unit includes a crease that allows it to be easily folded for storage and/or transportation of the jewelry organizer. The storage unit typically includes at least one crease to allow the storage unit to be easily folded in half. The storage unit may include two creases, arranged to allow the storage unit to be folded into thirds. Once the storage unit is folded, the closure allows the storage unit to remain closed for ease of storage and transportation. As used herein, a crease is simply a fold line along which the material of the storage unit can be easily folded.

The compartments can be of varying sizes as appropriate for the number of compartments that will be attached to the storage unit and for the items that will be stored within the storage unit. Typically, the compartments will be between about 2 inches wide and about 12 inches wide and will be between about 2 inches long and about 6 inches long. More typically, the compartments will be between about 2 inches wide and about 2 inches long and about 4 inches long. Most typically, the compartments will be about 2 inches wide and about 2 inches long.

In a typical configuration, there will be compartments of varying size that are removably attached to a storage unit. In such a configuration, the small size compartments are typically about 2 inches wide and about 2 inches long. A compartment that is one size larger will typically be about two times as wide and/or two times as long. Another compartment that is larger would typically be about three times as wide and/or three times as long. Typically, the smallest compartment is the standard width, and additional compartments are between about two times as wide and about 6 times as wide. Typically, the smallest compartment is the standard length, and additional compartments are between about two times as long and about 6 times as long.

This allows the compartments to be removably interchangeable at any location on the storage unit. A standard size compartment would take up one attachment location on the storage unit, and a compartment that is twice the width would take up two attachment locations on the storage unit. A compartment that is three times width would take up three attachment locations on the storage unit, and a compartment that is four times the width would take up four attachment locations on the storage unit.

The compartments can be any appropriate material for storage. Typically, the compartments are made of a plastic, such as PET. Typically, the compartments are essentially clear or see-through to allow a user to easily see what is stored within the storage compartment. Alternatively, the compartments can be made of a cloth or vinyl material.

The compartments each contain a seal to allow the compartment to be sealed and prevent any contents stored therein from spilling. Typically the seal is an interlocking strip fastener. Alternatively, the seal can be a mechanical fastener or a hook and loop fastener.

The compartments include a hook and loop fastener that allow it to be removably interchanged on the storage unit. The storage unit includes the corresponding side of the hook and loop fastener to allow the compartments to attach to the storage unit. Alternatively the compartments can be attached to the storage unit using a mechanical fastener such as a snap or button, or any other type of appropriate attachment mechanism.

Figure 2:
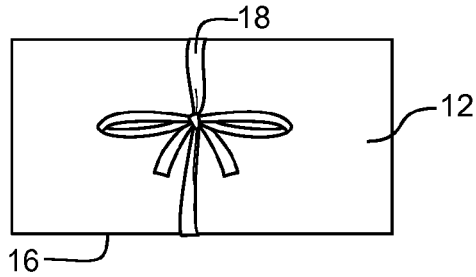
FIG. 2 is an illustration of a folded jewelry organizer in accordance with the present invention.
Figure 3:
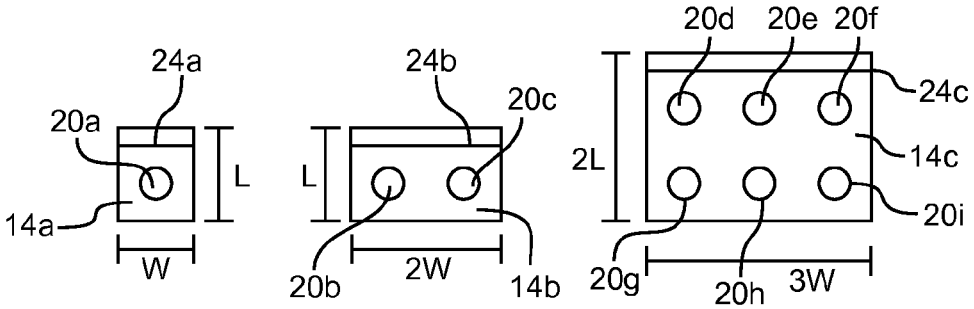
FIG. 3 is an illustration of compartments in accordance with the present invention.

A jewelry organizer 10 in accordance with the invention is generally illustrated in FIGS. 1-3. The jewelry organizer 10 includes a storage unit 12 and a plurality of compartments 14*a-c* that are removably attached to the storage unit 12. The storage unit 12 is generally rectangular in shape. Storage unit 12 includes a crease 16*a-b* that allows storage unit 12 to be easily folded along a crease 16*a* and a crease 16*b*. Storage unit 12 also includes a closure 18. Closure 18 is a tie closure that includes a closure tie 18*a* and a closure tie 18*b* that allows storage unit 12 to remain folded along crease 16*a* and crease 16*b* for ease in storage and travel, making jewelry organizer 10 more compact.

As seen in FIG. 3, compartment 14*a* has a length L, a width W, and a total of one attachment mechanism 20*a*. Compartment 14*b* has a length L; a width 2W, about two times the width of compartment 14*a*; and a total of two attachment mechanisms 20*b* and 20*c*, which are spaced apart in the width direction. Compartment 14*c* has a width 3W, about three times the width of compartment 14*a*, and a total of six attachment mechanisms 20*d-i*, which are arranged in three columns evenly spaced apart in the width direction. Likewise, compartment 14*c* has a length 2L about two times the length of compartment 14*a* and compartment 14*b*, and attachment mechanisms 20*d-l* are accordingly arranged in two rows spaced apart in the length direction. Thus, as illustrated in FIG. 3, each compartment 14*a-c* has a length equal to L times the number of rows of attachment mechanisms 20*a-i*, a width equal to W times the number of columns of attachment mechanisms 20*a-i*. Each compartment accordingly has an area equal to L times W times the number of attachment mechanisms, so that the ratio of the areas of any two of the compartments shown is equal to the ratio of their respective numbers of attachment mechanisms.

Compartment 14*a* includes an attachment mechanism 20*a* that allows compartment 14*a* to be attached to any of the storage unit attachment mechanism 22*a-r*. Attachment mechanism 20*a* and storage unit attachment mechanism 22*a-r* are corresponding hook and loop attachments.

Compartment 14*b* includes an attachment mechanism 20*b* and an attachment mechanism 20*c* that are a hook and loop attachment that allows compartment 14*b* to be attached to any of the storage unit attachment mechanisms 22*a-r*.

Compartment 14*c* includes an attachment mechanism 20*d-i* that are a hook and loop attachment that allows compartment 14*b* to be attached to any of the storage unit attachment mechanisms 22*a-r*.

Compartments 14*a-c* include a seal 24*a-c*. Seal 24*a-c* are an interlocking strip fastener and allow compartments 14*a-c* to be sealed, thus preventing any contents from spilling or falling out of compartments 14*a-c* during storage.

In another embodiment, the present invention is directed to a jewelry organization system. The jewelry organization system can be used to store and organize jewelry or fashion accessories, and to easily and compactly transport jewelry, fashion accessories or other items. Jewelry items that are typically stored include pairs of earrings, necklaces, bracelets, anklets, charms, rings, or any other type of jewelry that would fit in the compartments. Fashion accessories that can be stored and organized in the jewelry organizer include, but are not limited to, barrettes, ribbons, brooches, or any other fashion accessories that are appropriately sized to fit in the compartments.

Any other items that are appropriately sized to fit into the compartments can be stored and organized in the compartments. Examples of other items are makeup items such as makeup brushes, makeup applicators, eye shadow, eye liner, mascara, bronzer, blush, lipstick, lip gloss, lip balm, or any other makeup product. Additionally small items such as pills or vitamins can be stored in the compartments.

The jewelry organizer includes a storage unit, a compact unit, and a plurality of compartments that are removably attached to either the storage unit or to the compact unit. The storage unit is generally rectangular in shape. The compact unit is generally rectangular in shape. The compact unit is typically a smaller version of the storage unit.

The storage unit can be of varying sizes as appropriate for the number of compartments that will be attached to the storage unit. Typically, the storage unit will be between about 8 inches and about 24 inches wide and between about 8 inches and about 36 inches long. More typically, the storage unit is about 12 inches wide and is about 18 inches long.

The compact unit can be of varying sizes as appropriate for the number of compartments that will be attached to the compact unit. Typically, the compact unit will be between about 4 inches and about 12 inches wide and between about 6 inches and about 16 inches long. More typically, the storage unit is about 6 inches wide and is about 8 inches long.

The storage unit can be made of any appropriate material. Typically, the storage unit is made from a cloth material, such as cotton, polyester, or a cotton/polyester blended material. The storage unit can also include nylon, silk, rayon, or any other cloth material. Alternatively, the storage unit can be made from any plastic material, such as a PET material.

The compact unit can be made of any appropriate material. Typically, the compact unit is made from a cloth material, such as cotton, polyester, or a cotton/polyester blended material. The compact unit can also include nylon, silk, rayon, or any other cloth material. Alternatively, the compact unit can be made from any plastic material, such as a PET material.

The storage unit includes a closure. The closure can be any appropriate closure such as a tie closure, a zipper, a snap, hook and loop fasteners, or an elastic closure Typically the closure is a tie. The storage unit may also include a hanger in order to allow the storage unit to be easily hung for storage, such as in a closet or on a hook.

The compact unit includes a closure. The closure can be any appropriate closure such as a tie closure, a zipper, a snap, hook and loop fasteners, or an elastic closure Typically the closure is a tie. The compact unit may also include a hanger in order to allow the compact unit to be easily hung for storage, such as in a closet or on a hook.

The storage unit includes a crease that allows it to be easily folded for storage and/or transportation of the jewelry organizer. The storage unit typically includes at least one crease to allow the storage unit to be easily folded in half. The storage unit may include two creases, arranged to allow the storage unit to be folded into thirds. Once the storage unit is folded, the closure allows the storage unit to remain closed for ease of storage and transportation.

The compact unit includes a crease that allows it to be easily folded for storage and/or transportation of the compact unit. The compact unit typically includes at least one crease to allow the compact unit to be easily folded in half. The storage unit may include two creases, arranged to allow the compact unit to be folded into thirds. Once the compact unit is folded, the closure allows the compact unit to remain closed for ease of storage and transportation.

The compartments can be of varying sizes as appropriate for the number of compartments that will be attached to the storage unit and to the compact unit and for the items that will be stored within the storage unit. Typically, the compartments will be between about 2 inches wide and about 12 inches wide and will be between about 2 inches long and about 6 inches long. More typically, the compartments will be between about 2 inches wide and about 2 inches long and about 4 inches long. Most typically, the compartments will be about 2 inches wide and about 2 inches long.

In a typical configuration, there will be compartments of varying size that are removably attached to a storage unit. In such a configuration, the small size compartments are typically about 2 inches wide and about 2 inches long. A compartment that is one size larger will typically be about two times as wide and/or two times as long. Another compartment that is larger would typically be about three times as wide and/or three times as long. Typically, the smallest compartment is the standard width, and additional compartments are between about two times as wide and about 6 times as wide. Typically, the smallest compartment is the standard length, and additional compartments are between about two times as long and about 6 times as long.

This allows the compartments to be removably interchangeable at any location on the storage unit or on the compact unit. A standard size compartment would take up one attachment location on the storage unit or on the compact unit, and a compartment that is twice the width would take up two attachment locations on the storage unit or on the compact unit. A compartment that is three times width would take up three attachment locations on the storage unit or on the compact unit, and a compartment that is four times the width would take up four attachment locations on the storage unit or on the compact unit.

The compartments can be any appropriate material for storage. Typically, the compartments are made of a plastic, such as PET. Typically, the compartments are essentially clear or see-through to allow a user to easily see what is stored within the storage compartment. Alternatively, the compartments can be made of a cloth or vinyl material.

The compartments contain a seal to allow the compartment to be sealed and prevent any contents stored therein from spilling. Typically the seal is an interlocking strip fastener. Alternatively, the seal can be a mechanical fastener or a hook and loop fastener.

The compartments include a hook and loop fastener that allow it to be removably interchanged on the storage unit. The storage unit includes the corresponding side of the hook and loop fastener to allow the compartments to attach to the storage unit. Alternatively the compartments can be attached to the storage unit using a mechanical fastener or any other type of appropriate attachment mechanism.

Figure 4:
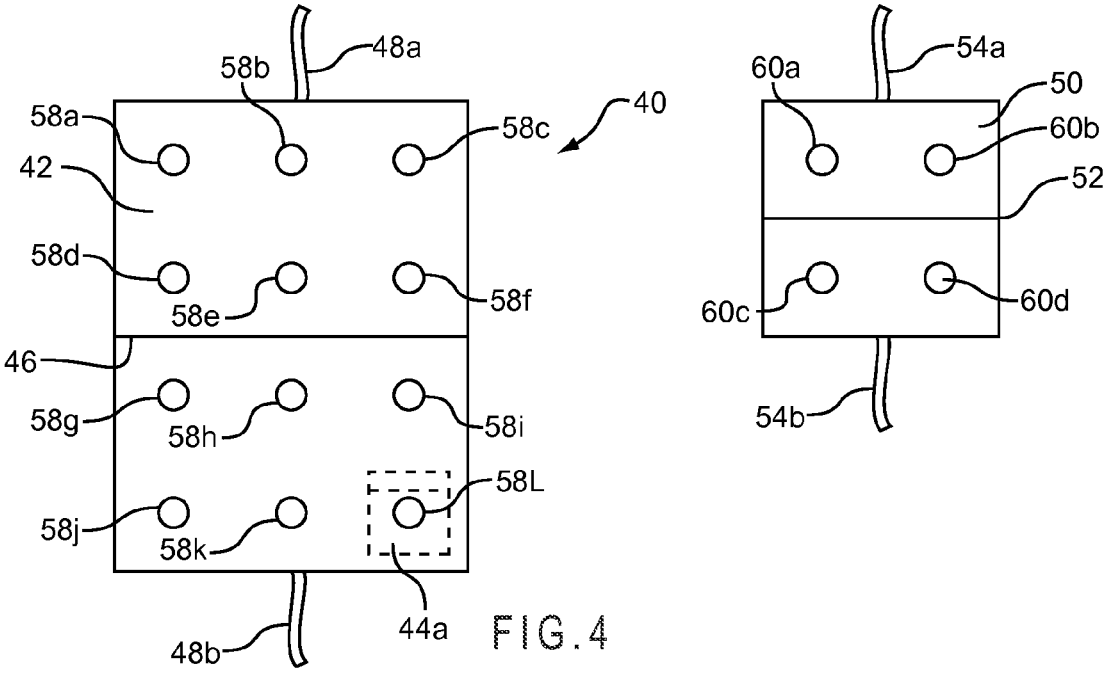
FIG. 4 is an illustration of a jewelry organizing system in accordance with the present invention.
Figure 5:
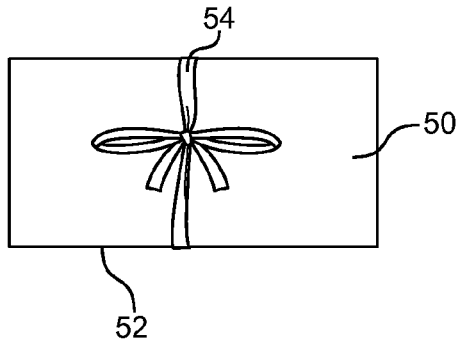
FIG. 5 is an illustration of another embodiment of a jewelry organizing system in accordance with the present invention.
Figure 6:
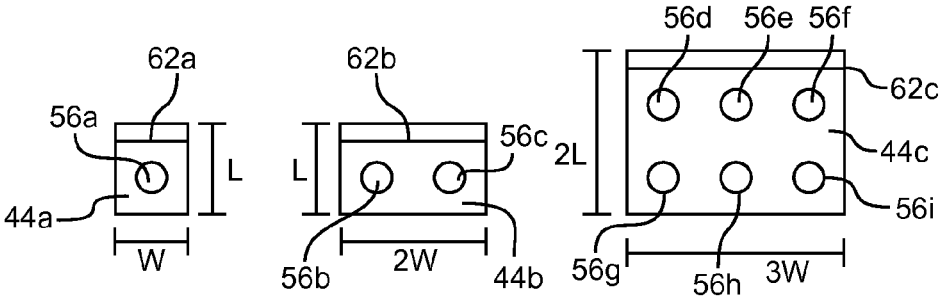
FIG. 6 is an illustration of compartments in accordance with the present invention.

A jewelry organization system 40 in accordance with the invention is generally illustrated in FIGS. 4-6. The jewelry organization system 40 includes a storage unit 42 and a plurality of compartments 44*a-c* that are removably attached to the storage unit 42. The storage unit 42 is generally rectangular in shape. Storage unit 42 includes a crease 46 that allows storage unit 42 to be easily folded in half along crease 46. Storage unit 42 also includes a closure 48. Closure 48 is a tie closure that allows storage unit 42 to remain folded along crease 46 for ease in storage, making storage unit 42 more compact.

Jewelry organization system 40 includes compact unit 50. The compartments 44*a-c* are removable attached to compact unit 50. Compact unit 50 is generally rectangular in shape. Compact unit 50 includes a compact unit crease 52 and a compact unit closure 54. Compact unit closure 54 is a tie closure that allows compact unit 50 to remain folded along compact unit crease 52 for ease in storage and transportation, and making compact unit 50 more compact and easier to use during travel.

As shown in FIG. 6, compartment 44*a* has a width W. Compartment 44*b* has a width 2W, about two times the width of compartment 44*a*. Compartment 44*c* has a width 3W, about three times the width of compartment 44*a*. Compartment 44*a* has a length L. Compartment 44*c* has a length 2L, about two times the length of compartment 44*a*. Thus, for compartments 44*a-c*, the same proportional relationship between the area of each compartment and the respective number of attachment mechanisms exists as that described above for compartments 14*a-c*, with reference to FIG. 3. Likewise, turning back to FIG. 4, it can be seen that attachment mechanisms 58*a*-L and 60*a-d* of storage unit 42 and compact unit 50 are similarly arranged in evenly spaced apart rows and columns. Accordingly, the total area of the attachment locations of the storage and compact units is proportional to their respective number of attachment mechanisms.

Compartment 44*a* includes an attachment mechanism 56*a* that allows compartment 44*a* to be attached to any of the storage unit attachment mechanism 58*a*-L or to any of the compact unit attachment mechanisms 60*a-d*. Attachment mechanism 56*a* and storage unit attachment mechanism 58*a*-L are corresponding hook and loop attachments. Attachment mechanism 56*a* and compact unit attachment mechanism 60*a-d* are corresponding hook and loop attachments.

Compartment 44*b* includes an attachment mechanism 56*b* and an attachment mechanism 56*c* that are a hook and loop attachment that allows compartment 44*b* to be attached to any of the storage unit attachment mechanisms 58*a*-L or to any of the compact unit attachment mechanisms 60*a-d*.

Compartment 44*c* includes an attachment mechanism 56*d-i* that are a hook and loop attachment that allows compartment 44*b* to be attached to any of the storage unit attachment mechanisms 58*a*-L or to any of the compact unit attachment mechanisms 60*a-d*.

Compartments 44*a-c* include a seal 62*a-c*. Seal 62*a-c* are an interlocking strip fastener and allow compartments 44*a-c* to be sealed, thus preventing any contents from spilling or falling out of compartments 44*a-c* during storage.

In another embodiment, the present invention is directed to a method for storing jewelry and fashion accessories. A jewelry organizer system is provided. The jewelry organizer system includes a generally rectangular storage unit, a generally rectangular compact unit including at least one crease and a closure, and a plurality of compartments. The compartments include a seal and are removably and interchangeably attached to either the storage unit or the compact unit. At least one of the compartments is filled with a piece of jewelry or fashion accessory. The filled compartment is attached to the storage unit. The filled compartment is subsequently removed from the storage unit and is attached to the compact unit. After the filled compartment is attached to the compact unit, the compact unit is folded along the crease, and the closure is closed. This allows the compact unit to be easily stored and transported.

EXAMPLES

The present invention is described in more detail with reference to the following non-limiting examples, which are offered to more fully illustrate the invention, but are not to be construed as limiting the scope thereof.

Example 1

A jewelry organizer is provided. The jewelry organizer has a storage unit and compartments. The compartments are removable and interchangeable on the jewelry organizer. The storage unit includes a hook and loop fastener. The compartments are rectangular and are about two inches wide by about two inches long. The compartments have an interlocking strip fastener along the top of the compartment. The interlocking strip fastener allows the compartment to be sealed so that any contents, such as jewelry or fashion accessories, can be easily stored in the compartment. The compartments include a hook and loop fastener on the back side of the compartment, which allows the compartment to be removably attached to the hook and loop fastener included on the storage unit. Each compartment is filled with one piece of jewelry or fashion accessory, such as a pair of earrings, a necklace, a bracelet, a ring, or a pair of barrettes. The compartments are attached to the storage unit, and when the item stored in the compartments is needed, the compartments are removed from the storage unit.

While the invention has been described with respect to certain preferred embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A jewelry organization system comprising:

a generally rectangular storage unit;

a generally rectangular compact unit that is separate from and smaller than the storage unit; and a plurality of compartments each comprising a seal;

wherein the storage unit and the compact unit each include a plurality of attachment mechanisms at a respective plurality of attachment locations, the total area of the attachment locations of the compact unit being smaller than the total area of the attachment locations of the storage unit, wherein each compartment includes an attachment mechanism adapted to attach to any of the attachment mechanisms of the storage unit and the compact unit, so that the compartments are removably and interchangeably attached to the storage unit or the compact unit at one or more of the attachment locations of the storage unit or the compact unit, and wherein the storage unit and compact unit attachment mechanisms are arrayed in a plurality of rows and a plurality of columns, the spacing between all adjacent rows of both the storage unit and compact unit being a uniform row spacing, and the spacing between all adjacent columns of both the storage unit and the compact unit being a uniform column spacing, the row and column spacing of the storage unit being the same as the row and column spacing of the compact unit, and the row and column spacing respectively defining the height and width of the attachment locations of the compact unit and the storage unit, so that the attachment locations of the compact unit and of the storage unit are all of the same size and shape; and wherein the compact unit comprises at least one crease and a closure.

2. The jewelry organization system of claim 1 wherein the closure is selected from the group consisting of a tie closure, a zipper closure, a mechanical fastener, a hook and loop closure, and an elastic closure.

3. The jewelry organization system of claim 1 wherein the attachment mechanisms of the storage unit and the compact unit comprise hook and loop fasteners, and the attachment mechanism of each compartment comprises a corresponding hook and loop fastener to removably and interchangeably attach the compartments to the storage unit or the compact unit.

4. The jewelry organization system of claim 1 wherein the compartments comprise plastic, and wherein the seal is an interlocking strip fastener.

5. The jewelry organization system of claim 1 wherein the compartments are generally rectangular in shape and are at least about two inches by about two inches in size.

6. The jewelry organization system of claim 1, further comprising at least two differently sized compartments, wherein the first compartment includes a first integer number of one or more first compartment attachment mechanisms configured to attach simultaneously to the first number of corresponding storage unit or compact unit attachment mechanisms at the respective first number of storage unit or compact unit attachment locations, and the second compartment includes a second number, different from the first number, of one or more second compartment attachment mechanisms configured to attach simultaneously to the second number of storage unit or compact unit attachment mechanisms at the respective second number of storage unit or compact unit attachment locations.

7. A method for storing jewelry comprising:

providing a jewelry organizer system comprising a generally rectangular storage unit, a generally rectangular compact unit that is separate from and smaller than the storage unit, and a plurality of compartments each comprising a seal, wherein each of the storage unit and the compact unit includes a plurality of attachment mechanisms at a respective plurality of attachment locations and each of the compartments includes an attachment mechanism adapted to attach to any of the attachment mechanisms of the storage unit and the compact unit, so that compartments are removably and interchangeably attached to the storage unit or the compact unit at any of the attachment locations of the storage unit or the compact unit, wherein the storage unit and compact unit attachment mechanisms are arrayed in a plurality of rows and a plurality of columns, the spacing between all adjacent rows of both the storage unit and the compact unit being a uniform row spacing, and the spacing between all adjacent columns of both the storage unit and the compact unit being a uniform column spacing, the row and column spacing of the storage unit being the same as the row and column spacing of the compact unit, and the row and column spacing respectively defining the height and width of the attachment locations of the compact unit and the storage unit, so that the attachment locations of the compact unit and of the storage unit are all of the same size and shape, the total area of the attachment locations of the compact unit being smaller than the total area of the attachment locations of the storage unit;

placing in one of the compartments a piece of jewelry or fashion accessory;

attaching the compartment to a first unit selected from the storage unit and the compact unit; and subsequently removing the compartment from the first unit and attaching the compartment to the other unit of the storage unit and the compact unit, wherein the other unit comprises at least one crease and a closure.

8. The method of claim 7 further comprising:

after the compartment is attached to the other unit, folding the other unit along the crease and closing the closure.

* * * * *

UNITED STATES PATENT AND TRADEMARK OFFICE

CERTIFICATE OF CORRECTION

PATENT NO. : 8,863,945 B2
APPLICATION NO. : 13/338817
DATED : October 21, 2014
INVENTOR(S) : Linda Davis It is certified that error appears in the above-identified patent and that said Letters Patent is hereby corrected as shown below:

In the Claims

Claim 6, col. 9, line 36, delete "integer".

Signed and Sealed this
Ninth Day of August, 2016

Michelle K. Lee

Michelle K. Lee
*Director of the United States Patent and Trademark Office*